United States Patent [19]

Major et al.

[11] Patent Number: 4,957,290

[45] Date of Patent: Sep. 18, 1990

[54] CROQUET GAME MODIFIED

[76] Inventors: John J. Major, 27220 SW. 143 Ave., Naranja, Fla. 33032; George Spector, 233 Broadway RM 3815, New York, N.Y. 10007

[21] Appl. No.: 435,552

[22] Filed: Nov. 13, 1989

[51] Int. Cl.[5] ..... A63B 71/00

[52] U.S. Cl. ..... 273/56; 273/127 R

[58] Field of Search ..... 273/108, 113, 123 R, 273/127 R, 129 R, 129 R, 394, 410, 56

[56] References Cited

U.S. PATENT DOCUMENTS

| | | | |
|---|---|---|---|
| 154,784 | 9/1874 | Bogia | 273/56 |
| 438,392 | 10/1890 | Ward | 273/56 |
| 838,763 | 12/1906 | Austin | 273/56 |
| 1,784,818 | 12/1930 | Bump | 273/56 |
| 3,556,370 | 12/1967 | Larsen | 273/56 |
| 3,647,216 | 3/1972 | Breslow | 273/127 R |
| 3,711,100 | 1/1973 | Crowder | 273/127 R |
| 3,865,375 | 2/1975 | Cosgrove | 273/127 R |

*Primary Examiner*—Theatrice Brown

[57] ABSTRACT

Modified croquet equipment is provided and consists of a gradual frustum conical shaped dish member having a center cup for receiving a ball which replaces the croquet stake. A modified U-shaped wicket is also provided in which each upright includes a pointed tip and a stationary ring carried midway thereon so that the wicket can be easily driven into the ground up to the stationary rings. In an alternate embodiment the dish member and the wicket can be height adjustable to change the pay of the croquet game.

1 Claim, 1 Drawing Sheet

CROQUET GAME MODIFIED

BACKGROUND OF THE INVENTION

The instant invention relates generally to outdoor lawn games and more specifically it relates to modified croquet equipment which provides dish members and wicket members.

There are available various conventional outdoor lawn games which do not provide the novel improvements of the invention herein disclosed.

SUMMARY OF THE INVENTION

A primary object of the present invention is to provide modified croquet equipment that will overcome the shortcomings of the prior art devices.

Another object is to provide modified croquet equipment in which the croquet game is improved by utilizing dish members instead of stakes and modified wickets.

An additional object is to provide modified croquet equipment in which each dish member and wicket can be height adjustable to change the play of the croquet game.

A further object is to provide modified croquet equipment that is simple easy to use.

A still further object is to provide modified croquet equipment that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
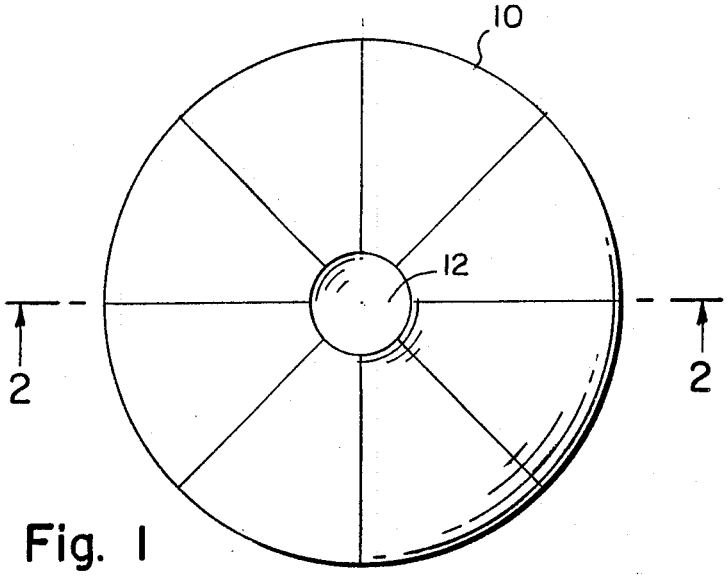
FIG. 1 is a top view of the dish member of the invention.
Figure 2:
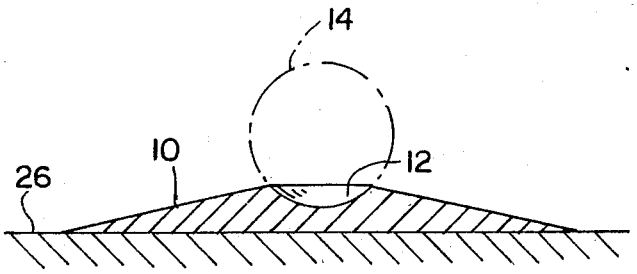
FIG. 2 is a cross sectional view taken along line 2—2 in FIG. 1.

Turning now descriptively to the drawings, in which similar reference characters denote similar elements throughout the several views, FIGS. 1 and 2 illustrate one piece of modified croquet equipment being a gradual frustum conical shaped dish member 10 having a center cup 12 for receiving a ball 14 during the play of the croquet game. The dish member 10 is used in place of a croquet stake (not shown).

Figure 3:
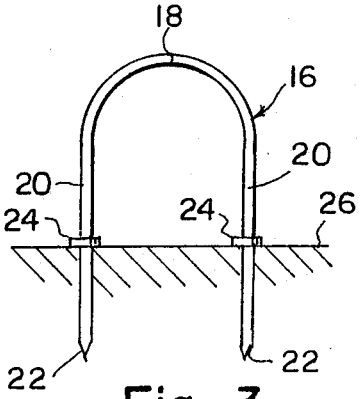
FIG. 3 is an elevational view of the modified wicket of the invention.

FIG. 3 shows another piece of modified croquet equipment being a modified U-shaped wicket 16 having a crown 18 and a pair of uprights 20. Each upright 20 includes a pointed tip 22 and a stationary ring 24 carried about midway thereon. The wicket 16 can be easily driven into the ground 26 up to each stationary ring 24.

Figure 5:
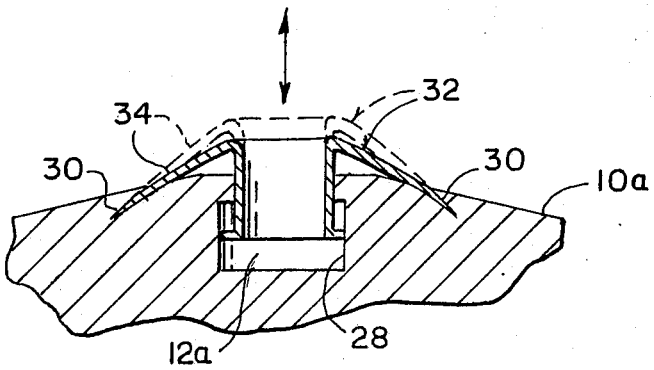
FIG. 5 is an enlarged cross sectional view of a portion of another type of dish member having a height adjustable sleeve in the center cup to change the angle of entry for a ball used during the play of the croquet game.

Am alternate dish member **10*a* is shown in FIG. 5 and includes a track 28 formed within the center cup 12*a*. An annular slot 30 is formed about the center cup 12*a*. A height adjustable sleeve 32 is provided and has a top annular flexible flange 34 extending downwardly therefrom. The sleeve 32 rides within the track 28 so that edge of the flexible flange 34 can move said annular slot 30 to change the angle of entry for the ball 4** used during the play of the croquet game.

Figure 4:
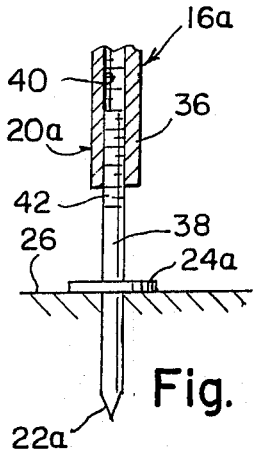
FIG. 4 is an enlarged detail view of another embodiment of the modified wicket in which the upright is adjustable for placing the wicket at different heights thereof.

FIG. 4 shows one upright **20*a* of an alternate wicket 16*a* which is height adjustable. The upright 20*a* is in two segments 36 and 38. The upper segment 36 has a threaded bore 40 therein while lower segment 38 has a threaded shank 42 which carries the pointed tip 22*a* and the stationary ring 24*a*. The threaded shank 42 threads into the threaded bore 40** to change the height thereof.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. Modified croquet equipment comprising, a gradual frustum conical shaped dish member having a tubular shaped, vertically extending center cup for receiving a ball during play of a croquet game;

(a) a track formed within a lower portion of said center cup;

(b) an annular slot spaced from said cup and formed in said dish member about said center cup;

(c) a height adjustable sleeve telescopingly fitting in said center cup and having means at one end thereof engaging said track an annular flexible flange having spaced apart edges, one of said edges being attached to the other end of said sleeve, said flange extending downwardly from said sleeve and having its other edge slidably engaging said slot said sleeve rides within said track so that said other edge of said flexible flange can move within said annular slot to change the angle of inclination of said flange relative to a playing surface and thus change the angle of entry into said cup of a ball used during the play of the croquet game.

* * * * *